US005768722A

United States Patent [19]

Olson et al.

[11] Patent Number: 5,768,722

[45] Date of Patent: Jun. 23, 1998

[54] TENT-LIKE STRUCTURE FOR YOUTH'S BUNK BED

[76] Inventors: Ana E. Olson, 8211 NW. 45th Ct., Lauderhill, Fla. 33351; Laurel Ruff, 75-5681 Kuakini Highway, Apt. #216, Kailua Kona, Hi. 96740

[21] Appl. No.: 874,844

[22] Filed: Jun. 13, 1997

[51] Int. Cl.[6] ..... A47C 19/22; A47C 21/00

[52] U.S. Cl. ..... 5/9.1; 5/512; 160/368.1; 135/119

[58] Field of Search ..... 5/9.1, 512, 414, 5/658; 160/354, 368.1, 327; 135/119, 115, 907

[56] References Cited

U.S. PATENT DOCUMENTS

| | | | |
|---|---|---|---|
| 249,376 | 11/1881 | Leve | 5/9.1 |
| 384,162 | 6/1888 | Hobbie et al. | 5/9.1 |
| 1,697,027 | 1/1929 | Stevenson | 5/512 |
| 3,237,778 | 3/1966 | Hoodis | 160/327 |
| 4,745,643 | 5/1988 | Clarke | 5/9.1 |
| 4,852,194 | 8/1989 | Langan | 5/512 |

FOREIGN PATENT DOCUMENTS

| | | | |
|---|---|---|---|
| 1272565 | 8/1961 | France | 5/512 |
| 2648026 | 12/1990 | France | 5/9.1 |

*Primary Examiner*—Alexander Grosz
*Attorney, Agent, or Firm*—Robert M. Downey, P.A.

[57] ABSTRACT

A tent-like structure to partially enshroud the space between an upper and lower mattress of a bunk bed; the structure is composed of panels suspended from the bed about the upper mattress which extend at least to the lower mattress.

9 Claims, 2 Drawing Sheets

TENT-LIKE STRUCTURE FOR YOUTH'S BUNK BED

FIELD OF THE INVENTION

This invention relates to a) a tent-like structure to partially enshroud a youth's bunk bed and form a type of partially enclosed playhouse between the lower and upper bunks and b) the combination of a bunk bed and such a structure.

BACKGROUND OF THE INVENTION

As an observer of children at play soon learns, whenever a child has an opportunity to play in a somewhat enclosed space, for example, under a table in a restaurant, he or she will do so. To satisfy this nesting type craving, playhouse-type toys are often found in parks and in the backyards of family homes. Indeed, many parents purchase playhouse-type toys of three-dimensional rigid plastic material which are set up within the family home. One problem is that such a playhouse occupies a relatively large space and cannot be readily assembled or disassembled for use or storage. In any event, in a family home, whether a playhouse-type toy is in use or in storage, a large space and considerable inconvenience are involved.

Moreover, children like to go camping, so much so that often there are small tents purchased and set up in the backyards of families for simulated camping. The small tents, if used overnight or for an extended period of time, expose the children to the elements, not to mention insect bites.

SUMMARY OF THE INVENTION AND OBJECTS OF INVENTION

Accordingly, this invention is of a tent-like or playhouse structure for easy attachment to a bunk bed to partially enshroud the space between the upper and lower mattresses. It can also be easily removed from the bed. With this invention, the children can play within a room of an actual house as if they were in a rigid playhouse of plastic material or camping in a tent. Children using this invention are not exposed to the elements and have the added advantage that they are within a home and where they can be kept under the close and watchful care of a family adult who is within hearing range. Another feature of the invention is that the structure being of foldable material, can be readily stored either in a department store or the home of a purchaser. The storage takes place in a package or on a shelf much as in the case of storage of sheets.

In general, the tent-like structure includes panels, for example, a pair of side panels and one or two opposite end panels. These panels are suspended from the upper bunk bed mattress support to drape partially about the space between the upper and lower bunk bed mattresses. A ribbon or cord which weaves through grommets formed around the periphery of the panels ties the panels to the bed in draped relation. Because most bunk beds are usually against a wall or in the corner, a fourth panel is not necessary. Each, or merely one, of the panels may be provided with a window opening, which may have a cover flap to open or close it. The flap may also have Velcro means for securing it closed. When the tent-like structure is installed on a bunk bed, children on the lower bunk are concealed behind the panels, as if in a tent; and they can pretend they are in a tent camping.

The invention generally is of a plurality of panels with suspension means to attach the panels to the bed so the panels drape about and partially enshroud the space between the upper and lower mattresses. The suspension means includes grommets spaced along the upper edge of the panels through which cloth ties extend to tie about the support for the upper mattress. The result is that the combined structure resembles a playhouse or a tent. Indeed, the panels draped along the longitudinal length of the bed resemble a door opening or more particularly flaps at a tent opening. Further, a tie member may be used to hold, releasably, the adjacent panels or flaps in a closed or even in an open position. Furthermore, one of the panels, or all of them, may be provided with window cuts, which may be spanned by transparent plastic, with, perhaps, a flap to open and close each tent "window."

In accordance with the foregoing, the invention will now be described on reference to the accompanying drawings in which:

DETAILED DESCRIPTION OF THE PREFERRED EMBODIMENT

Figure 1:
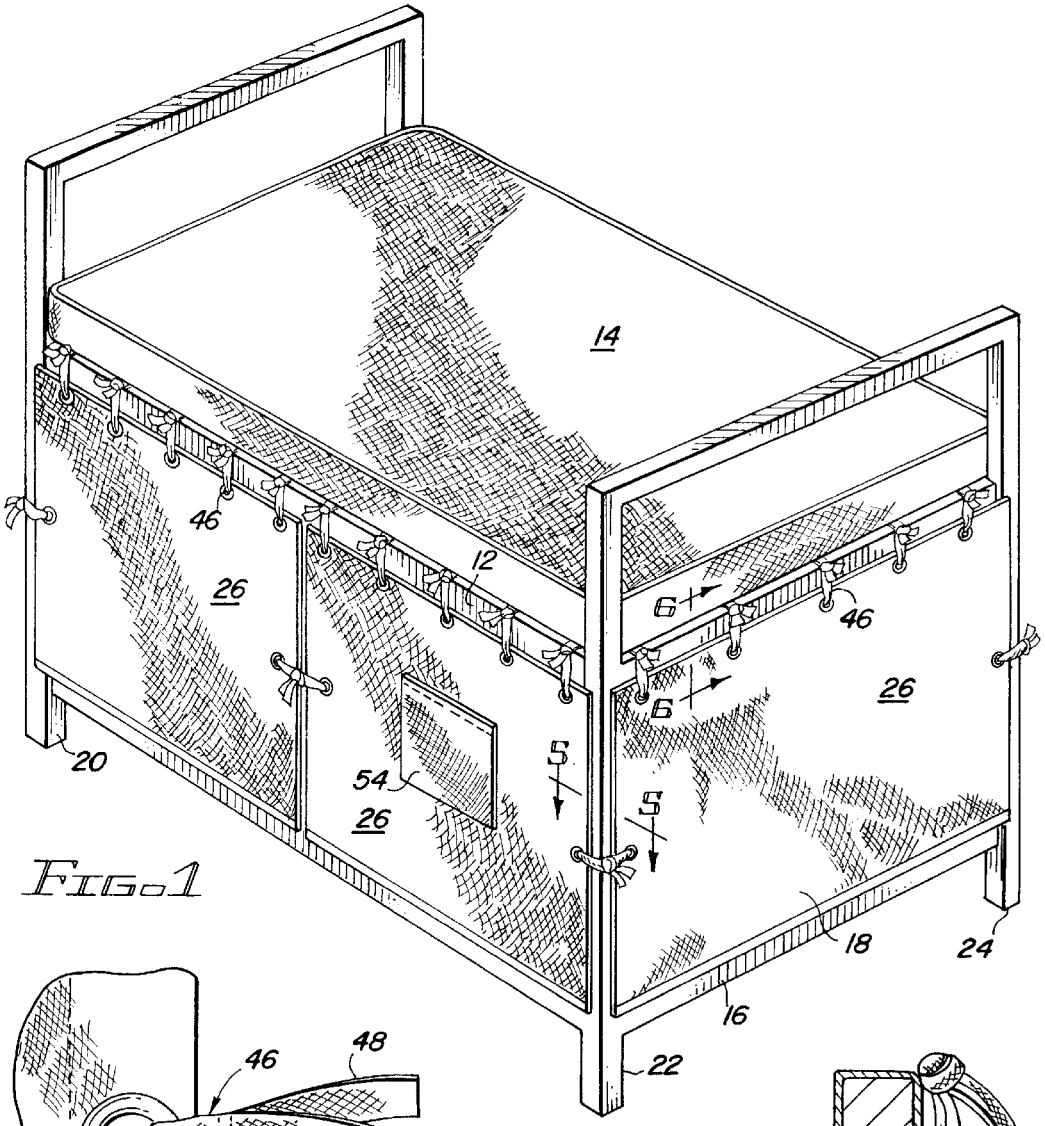
FIG. 1 is a perspective view of a bunk bed in assembly with a tent-like structure according to this invention, it being noted that, in the preferred embodiment, the width of the bunk bed is substantially one-half of the length of the bunk bed.
Figure 2:
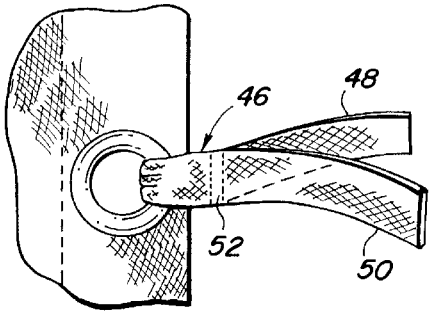
FIG. 2 is of a portion of one of the margins of one of the panels illustrating a grommet in the margin with a pair of lengths of a tie member extending from the grommet hole, and the length seamed together; the pair of lengths extending a sufficient length to tie around the vertical supports of the bunk bed or the rails of the upper mattress support structure.
Figure 5:
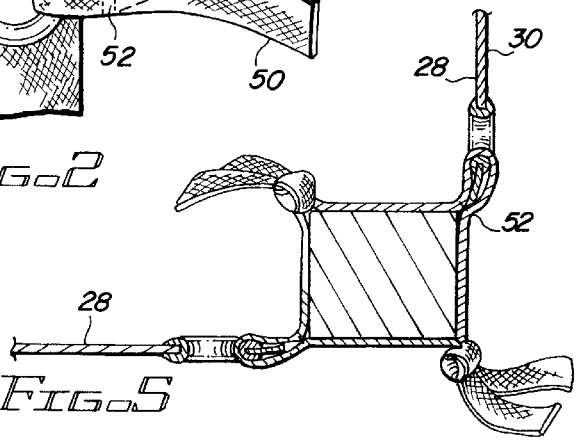
FIG. 5 is view taken on the plane indicated by the line 5—5 of FIG. 1 and looking in the direction of the arrows illustrating that one of each pair of ties is tied together while the other of each pair of ties is also tied together so as to connect an end panel to vertical supports of a bunk bed.
Figure 6:
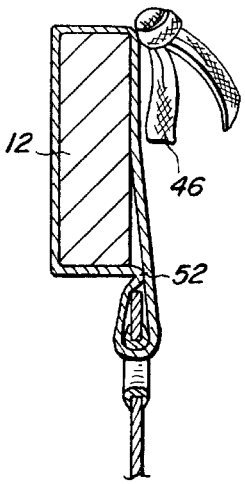
FIG. 6 is a view taken on the plane indicated by the line 6—6 of FIG. 1 and looking in the direction of the arrows and illustrating how the pairs of tie lengths are tied together to suspend the panels from the upper rail of a bunk bed.

Generally, this invention is of a tent-like structure alone or in combination with a bunk bed. The bunk bed is conventional in that it includes an upper horizontal peripheral rail structure to support an upper mattress and a lower horizontal rail structure to support a lower mattress. There is defined a space between the mattresses when in their respective rail structure which is of a predetermined height of about 3 feet. The tent-like structure is composed of panels of cloth material which through suspension means, enshroud the space, the suspension means connecting the panels to the rails of the upper rail structure, and the panels being sized so as to extend from the suspension means to the lower mattress. Also, means to releasably interconnect adjacent side edges are provide to simulate a tent opening which may be either open or closed.

More particularly, the bunk bed 10 is conventional and includes an upper horizontal peripheral rail structure generally indicated by the numeral 12 to support an upper mattress 14 and a lower peripheral rail structure 16 to support a lower mattress with a space 18 being defined between the rail structures. As is conventional vertical bed supports 20, 22, and 24 are provided at each corner. The tent-like structure is composed of a plurality of generally equi-sized foldable panels of cloth or cloth-like material in the preferred embodiment, the panels being generally designated by the numeral 26. Each panel has an inner surface 28, an outer surface 30, an upper edge 32, a lower edge 34, side edges 36 and 38 with a margin 40 along each edge. In a preferred embodiment, a strip of binding tape 42 is provided along the bottom or lower edge 34 of the panel and a plurality of generally equi-spaced grommets are provided in a pattern along the top edge; and a grommet is provided in each side edge about midway of the height of the panel in the side edge, the grommets being designated by the numeral 44.

Figure 3:
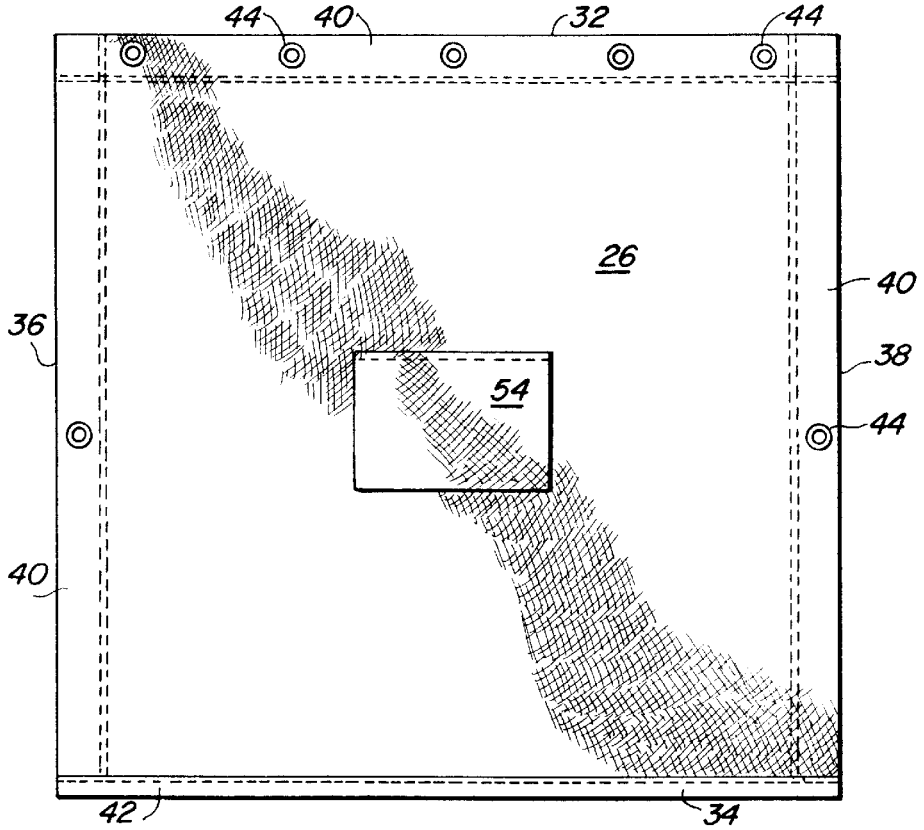
FIG. 3 is a view illustrating a panel which has been provided with a window cut and a flap overlaying the cut.
Figure 4:
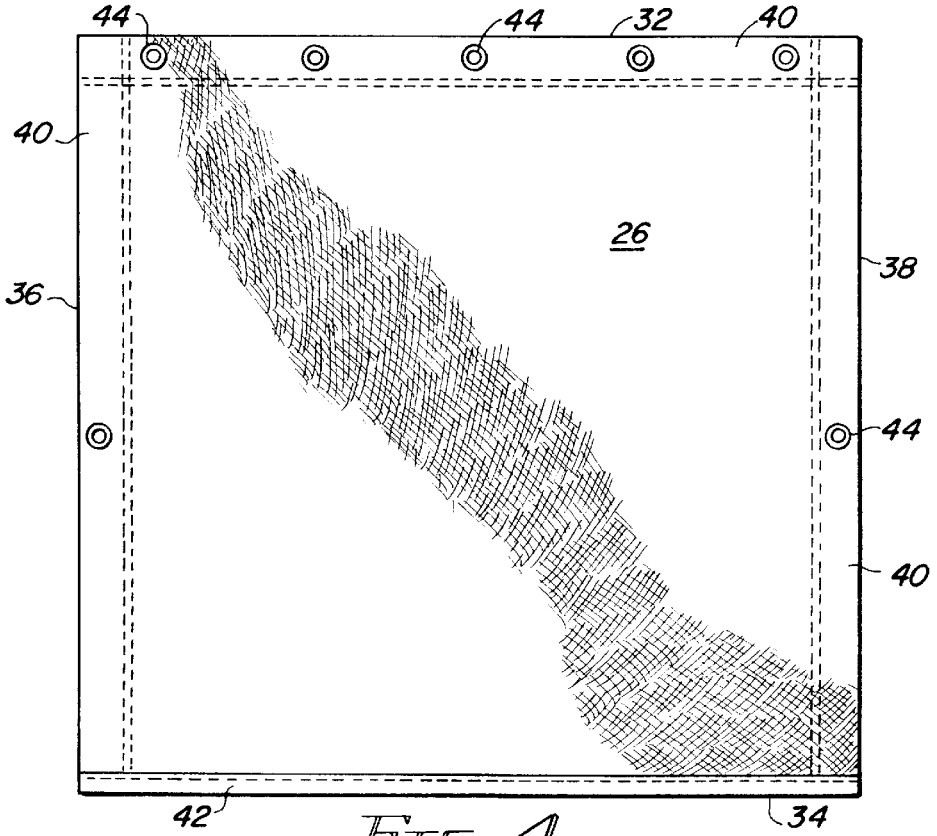
FIG. 4 is a view similar to FIG. 3 showing a panel without a window cut.

Finally, tie members are provided in each grommet. Each tie member 46 is of a length sufficient to extend through the grommet so that there are two extending lengths from each grommet 48 and 50 which are stitched together adjacent the panel by a suitable seam means. The pair of lengths 48 and 50 extending from each grommet are of a sufficient length to tie together about the head, foot, and side rails of the upper rail structure; and the tie members, extending from the panel side edges, are of a sufficient length to tie about the vertical supports of the bed. In the preferred embodiment, the side edges of two of the panels are adjacent one another simulating an opening of a tent wherein the two flaps may be secured together by the tie members. As seen in FIG. 3, one of the panels may be provided with a window cut and a flap to cover the opening, the window flap being designated by the numeral 54.

Some details of a preferred embodiment follow. The panels are preferably of canvas fabric and about 4 square yards of the material are required. Also, each of the hemmed panels is about 37 inches in height and 40 inches between the side edges. The lower edge of each panel preferably includes a ¾ inch thick cotton binding tape. In making the seams, No. 135 bonded thread is preferably used. The panel side edge margins are formed by the side edges being folded twice with the margin being ½ inch thick from the actual side edge of the panel. The top margin may be formed by a single fold with a stitched finished edge; and it is about ½ inch thick from the upper edge. The actual window cut or opening may be about 5 inches×7 inches in which case the window flap is preferably about 8 inches×10 inches. Also, the grommets are preferably of ⅜ inch nickel plated brass material. The panels may be of various colors and have decorative designs to carry out a motif or a theme. An example of such might be indicia of Cinderella's castle and related items.

It will be apparent that just as folded sheets or pillow cases may be packaged and sold as separate units or pairs of units, the panels of this invention may be so packaged and stored.

While this invention has been shown and described in what is considered to be a detailed practical embodiment, it is recognized that departures may be made within the spirit and scope of this invention and for this reason, the claims should not be limited except as set forth and within the doctrine of equivalents.

What is claimed is:

1. A tent-like structure for assembly with a conventional bunk bed wherein the conventional bunk bed includes an upper horizontal peripheral rail structure to support an upper mattress and a lower horizontal rail structure to support a lower mattress defining a space between the rail structures of a predetermined height of about three feet, and wherein each rail structure includes a head rail, foot rail, and parallel side rails and wherein vertical supports interconnect and support the upper and lower rail structure, said tent-like structure comprising:

a plurality of generally equi-sized panels of cloth material, each panel having an inner surface and an outer surface, an upper edge and a lower edge, and side edges spaced from one another a distance greater than the distance between the side rails;

each edge having a margin; and said upper and lower edges being spaced from one another a distance at least equal to the predetermined height;

the side edges and top edge comprising a multi-layer hemmed margin; and an extending cotton binding tape and stitch means securing said tape to said bottom edge;

a plurality of equi-sized grommets;

a plurality of generally through holes along the upper margin in a pattern parallel to the upper edge and one of said grommets bounding each through hole;

a hole in each side edge generally midway between the upper edge and lower edge and one of said grommets bounding each hole;

a plurality of upper tie members;

one of said members extending through each of the grommets in the top edge margin with each member defining a pair of lengths extending outboard of the top edge;

one of said members extending through each of said grommets in the side edges with each member defining a pair of lengths extending outboard of the side edges;

seam means to secure the pair of lengths of each tie member together adjacent the upper edge;

each of said pair of lengths extending from the upper edge being of a sufficient length to tie together about the head, foot and side rails of the upper rail structure;

each of the members extending from the side edges being of a sufficient length to tie about the vertical supports of the bed, whereby one of said panels may be suspended from the foot rail of the upper rail structure spanning the supports with its side edges being secured to the vertical supports; and two of said panels may be suspended from one of the side rails of the upper rail structure between the vertical supports with one of the side edges of each panel being secured to one of the vertical supports and with the other side edges of the two releasably secured together;

to form a partial enclosure about the space between the upper and lower rail structures of the bunk bed.

2. The tent-like structure as set forth in claim 1 which includes window means in one of the panels.

3. The tent-like structure as set forth in claim 2 wherein flap means are provided for opening and closing said window means.

4. The tent-like structure as set forth in claim 1 wherein each panel is of a height of about 37 inches and width of about 40 inches.

5. The tent-like structure as set forth in claim 1 wherein decorative indicia are provided on the outer surface.

6. In combination, a tent-like structure and a conventional bunk bed said conventional bunk bed including an upper horizontal peripheral rail structure to support an upper mattress and a lower horizontal rail structure to support a lower mattress and said mattresses defining a space between the rail structures of a predetermined height of about three feet, each rail structure including a head rail, foot rail, and parallel side rails and corner vertical supports interconnecting and supporting the rail structures, said tent-like structure comprising:

a plurality of generally equi-sized panels of foldable cloth material, each panel having an inner surface and an outer surface, an upper edge and a lower edge, said edges being spaced from one another a distance at least equal to the distance between the upper and lower rail structures; and side edges spaced from one another a distance greater than the distance between the side rails;

each edge having a margin;

the side edges and top edge comprising a multi layer hemmed margin;

a plurality of grommets;

a plurality of generally through holes along the upper margin in a pattern parallel to the upper edge and one of said grommets bounding each through hole;

a hole in each side edge generally midway between the upper edge and lower edge and one of said grommets bounding each hole;

a plurality of tie members;

one of said members extending through each one of the grommets and being tied to the rails of the upper rail structure or the vertical supports of the bed.

7. The combination as set forth in claim 6 which includes window means in one of the panels.

8. The combination as set forth in claim 7 wherein flap means are provided for opening and closing said window means.

9. The combination as set forth in claim 6 wherein each panel is of a height of about 37 inches and width of about 40 inches.

* * * * *